United States Patent [19]

Odashima

[11] 3,950,962

[45] Apr. 20, 1976

[54] SYSTEM FOR DEFROSTING IN A HEAT PUMP

[75] Inventor: Takeshi Odashima, Tokorozawa, Japan

[73] Assignee: Kabushiki Kaisha Saginomiya Seisakusho, Tokyo, Japan

[22] Filed: Apr. 29, 1974

[21] Appl. No.: 465,007

[30] Foreign Application Priority Data

May 1, 1973 Japan ..... 48-47573
June 11, 1973 Japan ..... 48-64766

[52] U.S. Cl. ..... 62/156; 62/208; 62/160

[51] Int. Cl.[2] ..... F25D 21/06

[58] Field of Search ..... 62/151, 156, 160, 324, 62/208

[56] References Cited

UNITED STATES PATENTS

| | | | |
|---|---|---|---|
| 2,968,167 | 1/1961 | Raney | 62/160 |
| 2,988,896 | 6/1961 | Swart | 62/160 |
| 3,097,502 | 7/1963 | Krueger | 62/160 |
| 3,400,553 | 9/1968 | Orbesen | 62/160 |

*Primary Examiner*—William E. Wayner
*Attorney, Agent, or Firm*—Woodhams, Blanchard and Flynn

[57] ABSTRACT

A system for defrosting a heat pump system employing a temperature difference type defrosting apparatus, wherein a heat sensitive means is provided at one portion of a pipe connecting an indoor heat exchanger with a four-way valve, and means provided between the pipe and the heat sensitive means for controlling the time required for transmitting the temperature of the pipe to the heat sensitive means. Owing to this system, the defrostation can be completely conducted and the defrosting cycle can terminate as soon as the defrosting has completed.

6 Claims, 8 Drawing Figures

SYSTEM FOR DEFROSTING IN A HEAT PUMP

The present invention relates to a system for defrosting a heat pump system, and more particularly to a system for defrosting, which can terminate the defrosting operation immediately upon removal of the ice or frost.

It is well known that in a heat pump apparatus employing the open air as a heat source, an evaporator in a heating cycle is sometimes used with its surface temperature below the freezing point and therefore, the outer surface of the evaporator becomes coated with frost which prevents heat exchange. Against the above disadvantages, there have been proposed some devices, for example, for defrosting the cycle is temporarily changed over to a cooling cycle and the evaporator in a heating cycle is made to act as a condenser in order to melt the frost by heat, and then the cycle returns to a heating cycle. Further, for automatic defrosting, there have been employed apparatuses of timer type and that of temperature-difference type.

In this connection it is to be noted that these conventional systems have some disadvantages and have no performance sufficient for completing apparatuses under any weather conditions.

As to an apparatus of temperature-difference type, initiation of defrosting is conducted rather precisely, but due to some bad conditions, for example when the wind blows heavily, especially when the apparatus is set up on the roof of a house or a building, even if the evaporator in a heating cycle acts as a condenser, the temperature of the outer surface of said temporary condenser does not rise to a temperature sufficient for the termination of the defrosting cycle because of a strong wind and the defrosting operation continues. As a result, the room temperature falls.

As to an apparatus of timer type, defrosting starts at regular intervals (usually every one hour) only at the time when the surface temperature of an evaporator in a heating cycle is low. And the temperature for initiation of defrosting is predetermined irrespective of open air temperature. With such construction, when the temperature of the evaporator in a heating cycle is just a little higher than the predetermined one, the defrosting is not carried out even if it is the time for defrosting. As a result, even though frost begins to build-up on the evaporator and the air temperature greatly falls, the defrosting cycle does not start until the next turn of time. Accordingly, a great deal of frost covers the evaporator in the heating cycle and the heating efficiency is strikingly lowered.

It is an object of the present invention to overcome such disadvantages and shortcomings as discussed above in connection with a defrosting system.

It is another object of the present invention to provide an improved system for defrosting in a temperature-difference type defrosting apparatus, wherein during the defrosting cycle even in a strong wind the defrosting operation can be forced to stop when the frost is completely melted away.

It is a further object of the present invention to provide a system for defrosting, wherein a cooling cycle can be changed over to heating cycle after complete defrosting irrespective of the amount of the frost stuck on the evaporator in the heating cycle, which amount varies depending upon weather conditions.

Essentially, according to the present invention, there is provided a system for defrosting in a heat pump, wherein a heat sensitive means used in a temperature-difference type defrosting apparatus for detecting the open air temperature is extendingly provided to come into contact with an outer wall of a pipe which connects an outlet of an expansion valve of an evaporator in the defrosting cycle with a four-way valve, and the defrosting cycle is forced to stop by the difference between the temperature of said heat sensitive means and that of a surface of a condenser in the defrosting cycle.

These and other objects and features of this invention will be better understood upon consideration of the following detailed description and the accompanying drawings in which.

Figure 1:
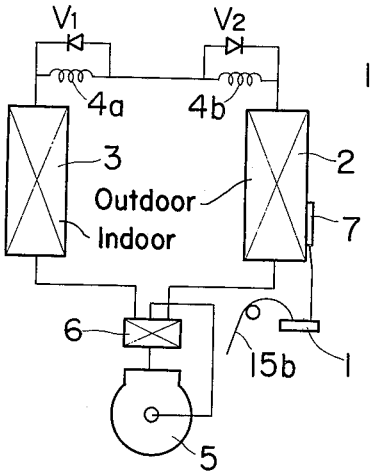
FIG. 1 PRIOR ART
FIG. 1 is a diagrammatic view showing a conventional temperature-difference type defrosting apparatus employed in a heat pump system.
Figure 2:
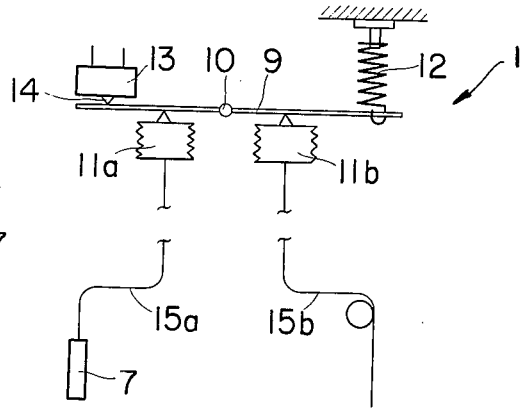
FIG. 2 PRIOR ART
FIG. 2 is a schematic view explaining the construction of the temperature-difference type defrosting apparatus of FIG. 1.

Referring now to FIGS. 1 and 2, there is illustrated a conventional heat pump system employing a defrosting apparatus. The system employs outdoor and indoor heat exchangers 2 and 3 respectively. Heat exchangers 2 and 3 respectively function as an evaporator and a condenser during a heating cycle, and they respectively function as a condenser and an evaporator during a defrosting cycle.

In a heating cycle, refrigerant from a compressor 5 circulates through a four-way valve (reversing valve) 6, a condenser 3, a capillary tube 4*a*, an expansion valve V2, an evaporator 2 and again through the four-way valve 6 to the compressor 5. The flow direction of the refrigerant is reversible. A defrosting apparatus 1 comprises a thermostat having a gas-sealed narrow pipe 15*b* for detecting the air temperature and said defrosting apparatus 1 detects the temperature of the surface of said evaporator 2 in the heating cycle by means of a heat sensitive cylinder 7. On one side of an actuating plate 9 are arranged pressure-responsive pieces 11a and 11b (bellows are employed in the embodiment shown in the drawings) at either side of a fulcrum 10, respectively, said pressure responsive pieces being made to contact with said actuating plate 9. To one end of the actuating plate 9 is engagingly connected a tension spring 12 and said actuating plate 9 is given a force to turn in a counterclockwise direction around the fulcrum 10. Further, on the other side of said actuating plate 9 is provided a micro-switch 13 opposite to said pressure-responsive piece 11*a* and a contact point 14 thereof is adapted to touch the actuating plate 9. The heat sensitive cylinder 7 provided at the outer surface of the outdoor heat exchanger 2 communicates with the pressure responsive piece 11*a* through the narrow pipe 15*a*, and the narrow pipe 15*b* for detecting the open air temperature communicates with the pressure responsive piece 11*b*.

Figure 3:
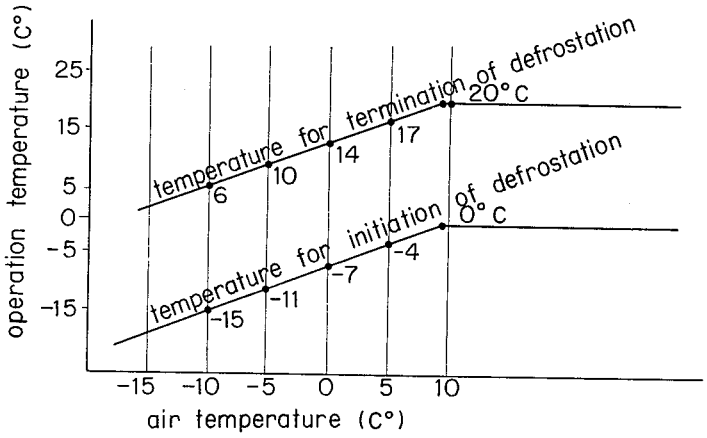
FIG. 3 PRIOR ART
FIG. 3 is a graph showing the relationship between air temperature and operation temperature in the system of FIG. 1.

With the construction described above, since the narrow pipe 15*b* which has detected the open air temperature actuates the pressure responsive piece 11*b* with a gas pressure corresponding to said temperature, the pressure of the pressure responsive piece 11*a* acts against the force of the tension spring 12 and the pressure responsive piece 11*b*, and the actuating plate 9 is made to touch or disengage said contact point 14 in accordance with the pressure in the pressure responsive piece 11*a*. In other words, in proportion to the open air temperatures, the temperature for termination of defrosting and for initiation of defrosting according to which the micro-switch 13 is turned-on or -off rise or fall. One example is shown in the graph of FIG. 3.

Figure 4:
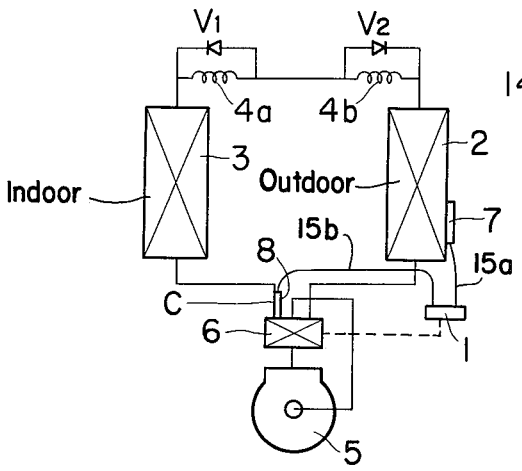
FIG. 4 is a diagrammatic view showing one form of a temperature-difference type defrosting apparatus employing a defrosting system of the present invention.
Figure 5:
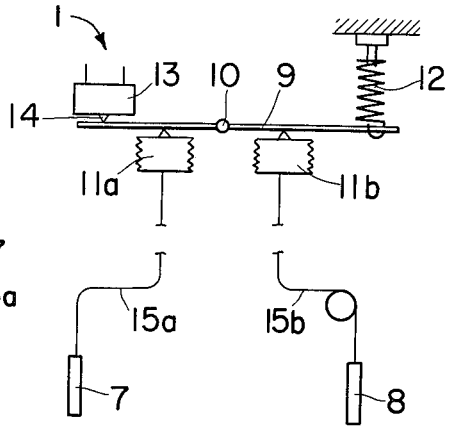
FIG. 5 is a schematic view explaining the construction of the defrosting apparatus of FIG. 4.

The improvement attained in the present invention is that in the defrosting apparatus of a type shown in FIG. 2, a heat sensitive means 8 as shown in FIGS. 4 and 5 is extendingly provided adjacent any desired portion *c* of a pipe (including a pipe in an evaporator) connecting an outlet of an expansion valve I (or a substitute therefor) and the four-way valve 6 so as to contact with an outer wall of the pipe, and the defrosting cycle can be forced to stop by the difference between the temperature of said heat sensitive means 8 and that of outdoor heat exchanger 2.

Figure 6:
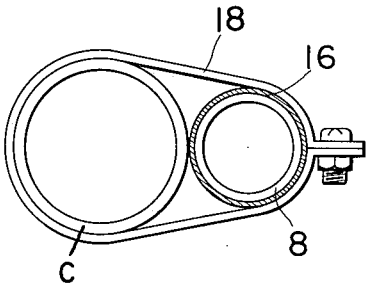
FIG. 6 is an enlarged fragmentary sectional view of one form of the principal part of the present invention.
Figure 7:
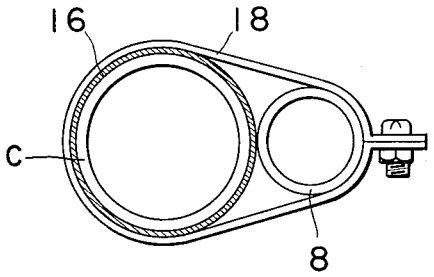
FIG. 7 is an enlarged fragmentary sectional view of another form of the principal part of the present invention.
Figure 8:
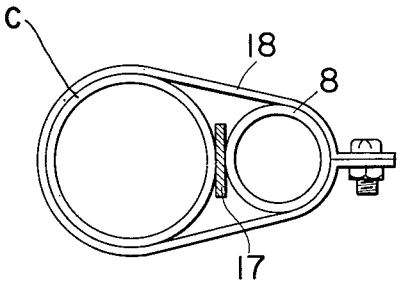
FIG. 8 is an enlarged fragmentary sectional view of a further form of the principal part of the present invention.

Referring to FIGS. 6–8, there is illustrated therein three variations of the heat sensitive means 8 and its association with the contact portion *c*. As illustrated in FIGS. 6 and 7, the heat sensitive means 8 or the contact portion c of the pipe has a sleeve-like coating of material 16 applied thereto, which material 16 has a smaller heat conductivity than the material forming the heat sensitive means of the pipe. The material 16 may thus comprise a vinyl resin film, leather, asbestos, etc. Alternately, as illustrated in FIG. 8, the heat sensitive means 8 and the pipe portion *c* may be made to contact one another through an intermediate element or plate 17, which plate 17 is of small heat conductivity, for example wood. A band 18 extends around the contact pipe *c* and the heat sensitive means 18 to maintain the plate 17 in engagement therebetween.

With such construction, it is possible to control the time required for transmitting the temperature of the pipe *c* to the heat sensitive means 8 and to control the defrosting period by varying the heat conductivity or thickness of the material 16 or the plate 17.

The portion *c* shown in FIGS. 4 and 5 generally has a temperature of about 20°C to 60°C in a heating cycle. When the four-way valve 6 is changed over for a defrosting cycle (cooling cycle) the temperature of said portion *c* gradually falls to about −20°C in about 10 minutes. Therefore, the temperature of the heat sensitive means 8 provided adjacent the portion *c* also falls to 0°C to −10°C in about 10 to 15 minutes, and finally to about −20°C as time passes. In the heat sensitive means 8 and the narrow pipe 15b connected to said means 8, there is sealed a mixture of fluid and gas refrigerant. The inner pressure thereof presents a saturated vapour pressure corresponding to the lowest temperature. Accordingly, the defrosting operation starts upon detecting the open air temperature at the narrow pipe 15*b* and, the defrosting cycle stops at a predetermined temperature of the outdoor heat exchanger 2 in the defrosting cycle, which is the same as in the conventional apparatus.

When a strong wind blows during a defrosting cycle, the temperature of the outdoor heat exchanger 2 is very slow in rising to (and in fact may never reach) the predetermined temperature required for termination of the defrosting cycle due to the cooling of the heat exchanger 2 as caused by the wind. In this instance the temperature of the heat sensitive means 8 adjacent the portion c gradually falls to a temperature lower than the open air temperature due to the low temperature of the refrigerant within the pipe *c*, and at the same time the saturated vapor pressure in the heat sensitive means 8 and in the narrow pipe 15*b* becomes low corresponding thereto, and then the pressure responsive piece 11*b* contracts, thereby to reduce the force for making the actuating plate 9 turn counterclockwise around the fulcrum 10. Accordingly, the temperature of the heat exchanger 2 required for termination of defrosting at the also decreases so as to permit termination of the defrosting operation. Thus, the defrosting operation terminates when the difference between the apparent open air temperature (the lower one of the temperatures sensed by the pipe 15*b* and the heat sensitive means 8) and the temperature of the outdoor heat exchange 2 reaches a predetermined value.

OPERATION

In a conventional defrosting system of the temperature-difference type, there are provided two heat sensitive means, one (such as 15*b* in FIGS. 1 and 2) for detecting the open air temperature, the other (such as 7 in FIGS. 1 and 2) for detecting the temperature of an outdoor coil, whereby the temperature at which a contact of a thermostat opens and closes varies depending upon the changes of the open air temperature. The advantage in a defrosting system of this kind is that as temperatures for initiation and termination of defrosting vary according to the open air temperature, the defrosting operation can accurately start and terminate at normal weather conditions. However, when the wind blows heavily in winter, and especially when an outdoor heat exchanger (such as a coil) is set up on a roof etc., the defrosting operation continues even after ice or frost has been removed since, due to the strong wind, the temperature of the surface of the outdoor coil does not rise so as to create a sufficient difference between the temperature of the open air and that of the surface of the outdoor coil to terminate the defrosting cycle.

According to the present invention, the above disadvantage of the conventional temperature-difference type defrosting apparatus can be overcome while making use of the merits thereof.

As mentioned above, in the conventional apparatus, there has not been considered any means against wind.

In order to overcome the above shortcoming, the present apparatus is provided with a function to forcibly terminate the defrosting cycle irrespectively of the temperature of the outdoor heat exchanger. Illustratively stated, and referring to the drawings, the narrow pipe (capillary tube) 15*b* for detecting the open air temperature is extended and provided with the heat sensitive means 8 at the end thereof, and said heat sensitive means 8 is provided adjacent any desired portion *c* of the pipe connecting the indoor heat exchanger 3 with the reversible valve 6 as depicted in FIGS. 4 and 5. The pressure responsive piece (bellows) 11*b*, the narrow pipe 15*b* and the heat sensitive means 8 are charged with a freon gas in the state of a saturated vapor. (Generally this is called "gas-charged") Therefore, a gas pressure at the bellows 11*b* is equal to the saturated vapor pressure corresponding to the lowest one of the temperatures in the system connecting the bellows 11*b*, the narrow pipe 15*b* and the heat sensitive means 8. This phenomenon is well known to those skilled in the art.

Thus, in a heating cycle, the pressure in the bellows 11*b* is the one corresponding to the temperature of the narrow pipe 15*b*. When the frost begins to cover the outdoor coil 2, the temperature sensed by the heat sensing means 7 begins to fall until the temperature difference between the open air and heat sensing means 7 reaches the predetermined value sufficient for initiation of the defrosting operation. Once the defrosting operation starts, the frost can be melted away within about 5 to 8 minutes when windless, and the temperature of the outdoor coil again rises to terminate the defrosting cycle.

As can be seen from FIG. 3, at normal weather conditions (assuming that the open air temperature detected by the narrow pipe 15*b* is now −5°C.), defrosting starts and terminates when the temperature detected by the heat sensing means 7 is −11°C. and +10°C., respectively.

Up to the above point, the operation is similar to the conventional one. However, when the wind blows heavily, the temperature of the outdoor coil does not rise sufficiently to create the predetermined temperature differential between heat sensing elements 7 and 15*b* necessary for termination of defrosting, and thus the defrosting operation continues even after the frost has melted away.

Now , in the present invention, there is also provided the heat sensing means 8 adjacent the pipe connecting the indoor heat exchanger 3 to the reversing valve 6. The temperature of this pipe falls during the defrosting cycle to between about −25°C. and −30°C. because of the flow of the refrigerant, and the temperature of the heat sensing means 8 also falls to between about −15°C. and −20°C. within 10 to 15 minutes, when the open air temperature is −5°C. At this instant, as explained hereinbefore, the pressure in the bellows 11b corresponds to the lower temperature, to wit, the temperature of the heat sensing means 8 because they are all gas-charged. There is thus obtained the same condition as when the open air temperature falls to −15°C. to −20°C. Illustratively stated (see FIG. 3), even if the open air temperature is −5°C. and the temperature of the outdoor coil rises only to +5°C., so long as the temperature of the heat sensing means 8 falls for example to −15°C., which is sensed as an apparent open air temperature, the defrosting operation will terminate at a temperature of about +3°C. (as read from FIG. 3). Therefore, since the temperature of the outdoor heat exchanger is +5°C. (higher than 3°C.), the defrosting cycle terminates and is changed to the heating cycle. In other words, the defrosting operation terminates when the difference between the apparent operation terminates when the difference between the apparent open air temperature (lower one of the temperatures sensed by the narrow pipe 15*b* and the heat sensing means 8) and the temperature of the outdoor heat exchanger reaches the predetermined value.

As described, according to the present invention, there can be obtained an improved system for defrosting in a temperature-difference type defrosting apparatus used in a heat pump, wherein disadvantages which have been found at the end of a defrosting cycle and have never been overcome by any conventional system can be overcome. Further, under any weather conditions the present apparatus can choose the most proper defrosting period by itself. Therefore the defrosting cycle terminates as soon as the defrosting is completed. Thus, the present invention greatly contributes to heighten the practical efficiency of the heat pump.

What is claimed is:

1. In a heat pump system having indoor and outdoor heat exchanger means associated therewith and functioning respectively as a condenser and an evaporator during a heating cycle, expansion valve means connected between said indoor and outdoor heat exchanger means, compressor means associated with said indoor and outdoor heat exchanger means for controlling flow to and from same, shiftable flow control valve means associated with said compressor means for controlling the flow from said compressor means to and from said indoor and outdoor heat exchanger means, conduit means connected between said indoor heat exchanger means and said flow control valve means, and defrosting means associated with said outdoor heat exchanger means for defrosting same, said defrosting means causing said system to operate in reverse whereby said indoor and outdoor heat exchanger means respectively operate as an evaporator and a condenser, said defrosting means including first heat sensing means for detecting the temperature of the surface of said outdoor heat exchanger means and second heat sensing means for detecting the temperature of the surrounding air, and means responsive to said first and second heat sensing means for actuating the flow control valve means to terminate the defrosting cycle upon sensing a predetermined temperature difference between said first and second heat sensing means, the improvement comprising controlling means for terminating the defrosting cycle irrespective of the actual temperature difference between said first and second heat sensing means, said controlling means including a third heat sensing means disposed adjacent the conduit means connected between the shiftable flow control valve means and the indoor heat exchanger means for terminating the defrosting cycle when a sufficient temperature difference exists between said first and third heat sensing means.

2. A system according to claim 1, wherein said third heat sensing means includes a heat sensitive element disposed adjacent said conduit means, and means associated with said heat sensitive element for controlling the time required for transmitting the temperature of the conduit means to the heat sensitive element to thereby provide sufficient time for defrosting to occur.

3. A system according to claim 2, wherein the means for controlling the time comprises an intermediate member disposed between and engaged with said heat sensitive element and said conduit means, said intermediate member being constructed from a material having a lower heat conductivity than both the conduit means and the heat sensitive element.

4. A system according to claim 3, wherein said heat sensitive element comprises a pipelike part disposed adjacent and substantially parallel to said conduit means, said intermediate member being disposed between and engaged with both said conduit means and said pipelike part, and collar means surrounding said conduit means and said pipelike part for fixedly connecting same.

5. A system according to claim 5, wherein the responsive means is operatively connected to both said second and third heat sensing means and receives a signal corresponding to the lower temperature of the temperatures sensed by the second and third heat sensing means, said responsive means causing actuation of the flow control valve means to terminate the defrosting cycle when said predetermined temperature difference exists between the temperature sensed by said first heat sensing means and the lower temperature of the temperatures sensed by said second and third heat sensing means.

6. A system according to claim 5, wherein said third heat sensing means includes a heat sensitive element disposed adjacent said conduit means, and insulating means associated with said heat sensitive element for controlling the time required for transmitting the temperature of said conduit means to said heat sensitive element to thereby provide sufficient time for defrosting to occur in those instances where the termination of the defrosting cycle is being controlled by the temperature difference between said first and third heat sensing means.

* * * * *

UNITED STATES PATENT AND TRADEMARK OFFICE

CERTIFICATE OF CORRECTION

PATENT NO. : 3 950 962

DATED : April 20, 1976

INVENTOR(S) : Takeshi Odashima

It is certified that error appears in the above–identified patent and that said Letters Patent are hereby corrected as shown below:

Column 7, line 5; delete "Claim 5" and insert ---Claim 1---.

Signed and Sealed this

Twentieth Day of July 1976

[SEAL]

*Attest:*

RUTH C. MASON
*Attesting Officer*

C. MARSHALL DANN
*Commissioner of Patents and Trademarks*